US006390872B1

(12) United States Patent
Davis

(10) Patent No.: US 6,390,872 B1
(45) Date of Patent: May 21, 2002

(54) SURFBOARD HAVING IMPROVED LEASH PLUG ANCHORING

(75) Inventor: Corey Croson Davis, Cannon Beach, OR (US)

(73) Assignee: Hammer LLC, Cannon Beach, OR (US)

( * ) Notice: Subject to any disclaimer, the term of this patent is extended or adjusted under 35 U.S.C. 154(b) by 0 days.

(21) Appl. No.: 09/513,622

(22) Filed: Feb. 25, 2000

(51) Int. Cl.[7] ..... B63B 35/79
(52) U.S. Cl. ..... 441/75
(58) Field of Search ..... 441/75, 74; 114/39.12, 114/39.19

(56) References Cited

U.S. PATENT DOCUMENTS 4,528,924 A * 7/1985 Marker et al. ..... 114/39.19
4,753,836 A * 6/1988 Mizell ..... 428/316.6
4,797,312 A * 1/1989 Sherwood ..... 264/45.3
4,804,347 A * 2/1989 Ross ..... 114/357
5,127,861 A * 7/1992 Ross ..... 114/357

* cited by examiner

*Primary Examiner*—Sherman Basinger
(74) *Attorney, Agent, or Firm*—Law Office of Timothy E. Siegel; Timothy E. Siegel

(57) ABSTRACT

A surfboard, comprising a blank made of lightweight, semi-rigid material and having a top major surface. A layer of resin-impregnated cloth adhered to the top major surface and a leash plug including a cup portion that is set into the top major surface of the blank and at least one extension that is interposed between the blank and the layer of resin-impregnated cloth.

14 Claims, 3 Drawing Sheets

SURFBOARD HAVING IMPROVED LEASH PLUG ANCHORING

BACKGROUND OF THE INVENTION

The present invention has to do with a surfboard having a leash plug that is a more thoroughly anchored band than the leash plug of any presently available surfboard and method of manufacturing the same. The leash plug of a surfboard retains the surfboard leash. This is a line of extruded polyurethane bearing a loop of woven material on its distal end for a surfer to retain about his ankle. When the surfer is thrown off his surfboard, the leash retains the surfboard. This is an important function because a surfboard typically costs $450 or more. Even more important, however, is the prevention of accidents that a loose surfboard could cause to the surfer (who owns the board), as well as other people in the general area. More specifically, a loose surfboard has the potential to seriously injure or kill a surfer or a swimmer.

Today, a surfboard is manufactured by starting with a blank made of lightweight polystyrene (STYROFOAM™ being the most familiar trademark for this type of material) or polyurethane that is in the general shape of a surfboard and then adding many layers of resin-impregnated fiberglass cloth around it. This procedure is known as "glassing" the board. After the board is glassed, additional layers of resin may be added to strengthen the board. In the next phase, a small hole is punched through the layers of resin-impregnated fiberglass cloth and into the blank. Resin is poured into this hole and a leash plug is inserted into the resin-filled hole.

After the leash plug has been correctly positioned, the board manufacturing operation must be temporarily halted while the resin sets. Any interruption in the manufacturing process is costly because it forces the manufacturer to give up a portion of his manufacturing space to accommodate the partially manufactured board. Alternatively, the manufacturer may stow the partially manufactured board and retrieve it after the resin has set. Although this second option does not waste manufacturing space, it does require a place to stow the partially assembled boards and the additional labor to do so.

Additionally, leash plugs installed according to this method have some vulnerability to being pulled out by a particularly strong wave. The importance of avoiding the resultant loosing of a surfboard have been noted above.

To lessen the likelihood that the leash plug will be pulled out, many large surfboards sport two leash plugs. This, of course, increases the cost of manufacturing the surfboard. Moreover, it is generally more convenient to the surfer to have the leash installed in a single place on the surfboard.

SUMMARY

In a first separate, the present invention is a surfboard, comprising a blank made of lightweight, semi-rigid material and having a top major surface and a layer of resin-impregnated cloth adhered to the top major surface. In addition, a leash plug includes a cup portion and an extension and is set into the blank so that the extension is interposed between the blank and the layer of resin-impregnated cloth.

In a second separate aspect, the present invention is a method of manufacturing a surfboard, that begins with providing a blank of lightweight semi-rigid material having a top major surface and then forming an indentation in the blank at the top major surface. Further, a leash plug is provided having a cup portion and an extension that extends outwardly from the cup portion. Next, the cup portion is placed in the indentation so that the extension extends outwardly from the cup over a portion of the top major surface. A cloth is placed over the top major surface, so that the extension is interposed between the top major surface and the cloth. At some point the cloth is impregnated with resin and the resin is cured.

In a third separate aspect, the present invention is a leash plug having a top and a bottom and comprising a cup portion, traversed by a cross-bar. In addition, a rim extends outwardly from the cup portion and a retention wall extends downwardly, substantially at a right angle to the rim.

The foregoing and other objectives, features and advantages of the invention will be more readily understood upon consideration of the following detailed description of the preferred embodiment(s), taken in conjunction with the accompanying drawings.

DETAILED DESCRIPTION OF THE PREFERRED EMBODIMENT

Figure 1:
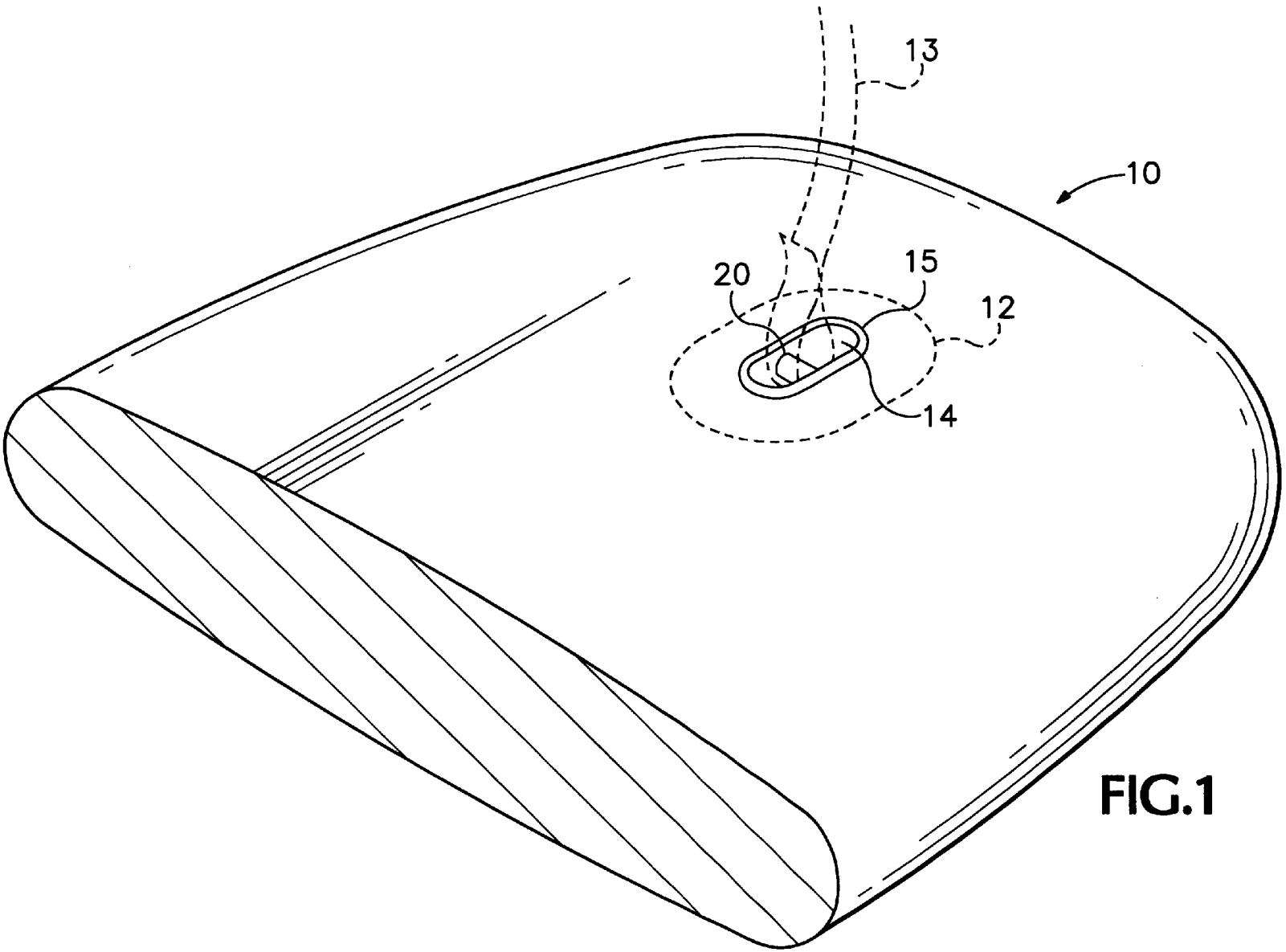
FIG. 1 shows a partial perspective view of a surfboard according to the present invention.
Figure 2:
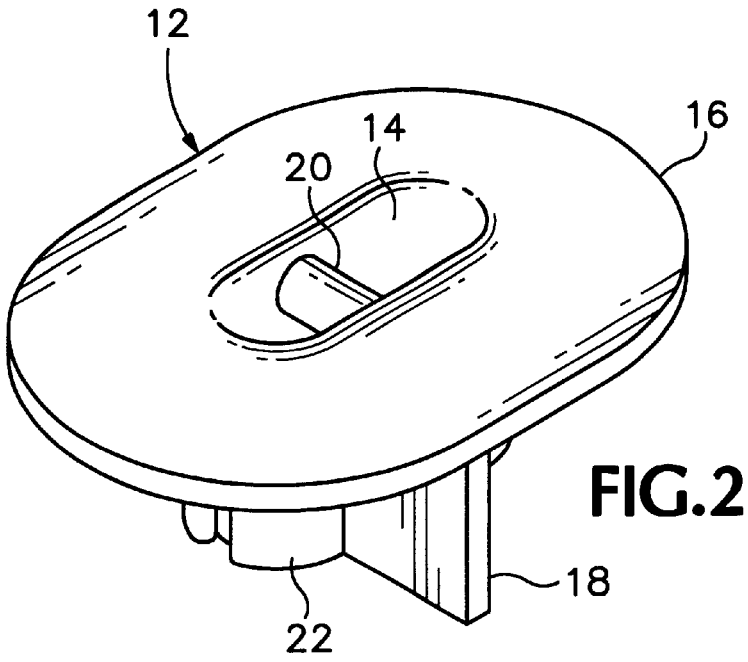
FIG. 2 is a perspective view of a leash plug according to the present invention.
Figure 3:
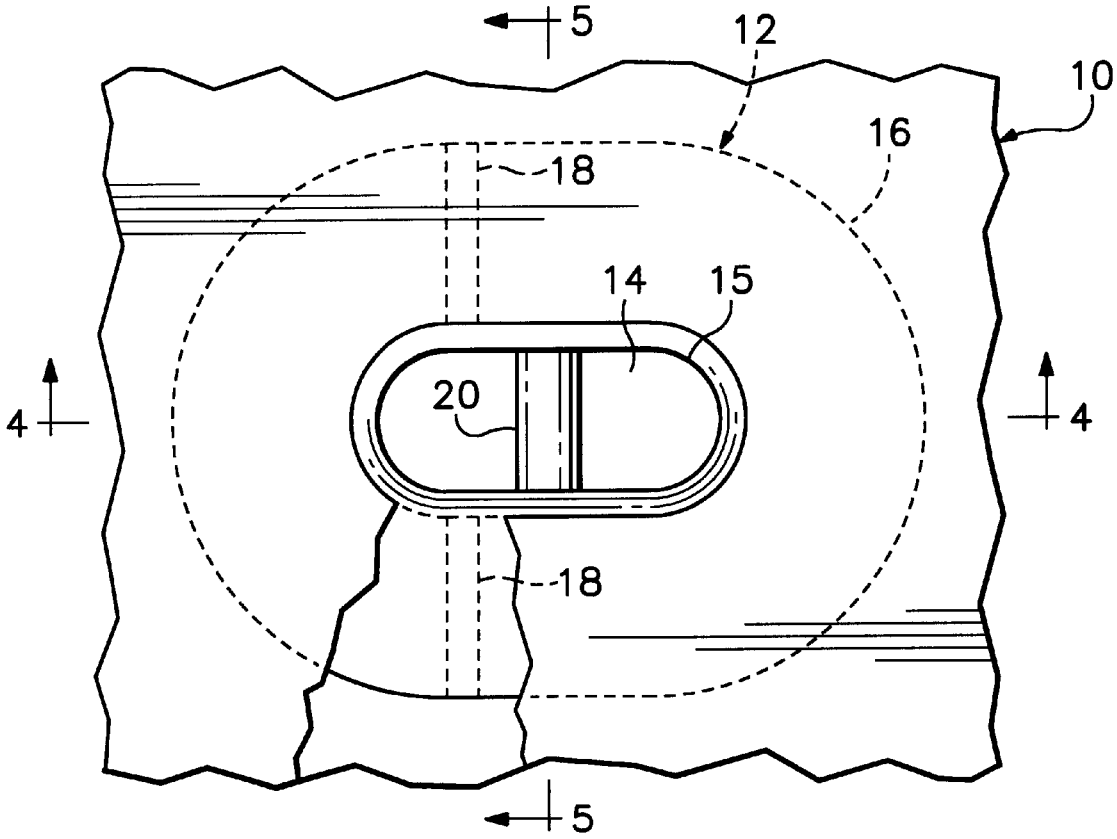
FIG. 3 is a top sectional view of the surfboard of FIG. 1.

Referring to FIGS. 1 and 2, a preferred embodiment of a surfboard 10 according to the present invention is built using a leash plug 12, for retaining a leash 13. Leash plug 12 includes a cup portion 14 encircled at its top by an annular ridge 15 and an extension or rim 16 extending outwardly from rim 16; a wall 18 depending downwardly from the rim 16; and a cross-bar 20, crossing the top of the cup portion 14 and providing an attachment point for the surfboard leash 13. Additionally, a lip 22 extends downwardly from the exterior of cup portion 14.

Referring to FIGS. 1–5, a surfboard according to the present invention is constructed by providing a blank 24 made of lightweight cellular polystyrene (STYROFOAM™ being the most familiar trademark for this type of material, as noted earlier) or polyurethane. A shallow depression, typically shaped to accommodate the cup portion 14 and rim 16 of leash plug 12, is formed (typically by a router) in the place where the leash plug 12 is slated to be positioned. A tape is placed over the opening of cup portion 14 to prevent it from receiving resin during the glassing operation described below and acetone is used to wipe any mold release agent or other coating from plug 12. Then leash plug 12 is pushed into this depression and is anchored in place by the wall 18 and the lip 22, which are coated with resin and cut into the polystyrene material of the blank 24. In one preferred method, some resin is brushed onto the bottom of the plug 12 prior to pushing the plug 12 into the depression. This is meant to help retain the plug 12 during manufacturing and to add strength to the plug-to-blank bond.

Figure 6:
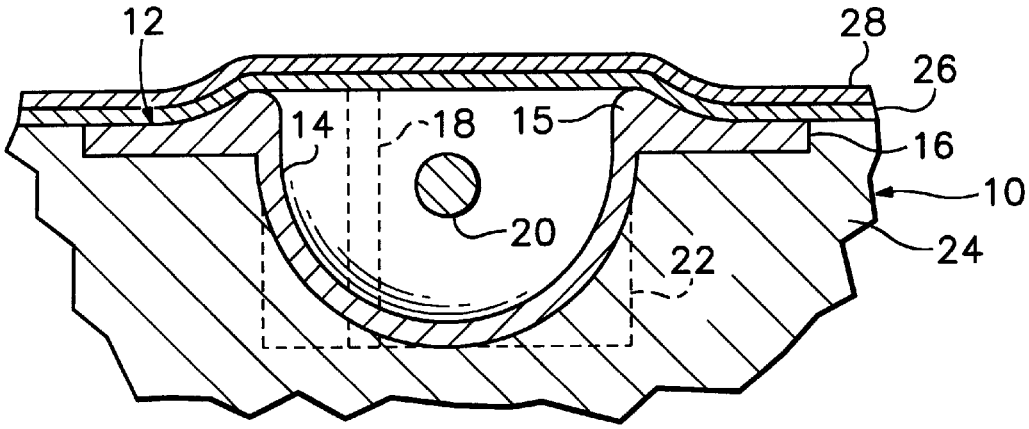
FIG. 6 is a partial cross-section taken along line 4—4 of FIG. 3 of a manufacturing step in the production of the surfboard of FIG. 1.

Next, the board is "glassed." Glassing entails the addition of a pair of resin-impregnated layers of fiberglass cloth 26 and 28 onto blank 24. FIG. 6 shows a cross-sectional view of the leash plug 12 retained in the surfboard 10 immediately after the glassing operation. In some instances a further coat of resin is applied after glassing is completed.

Figure 4:
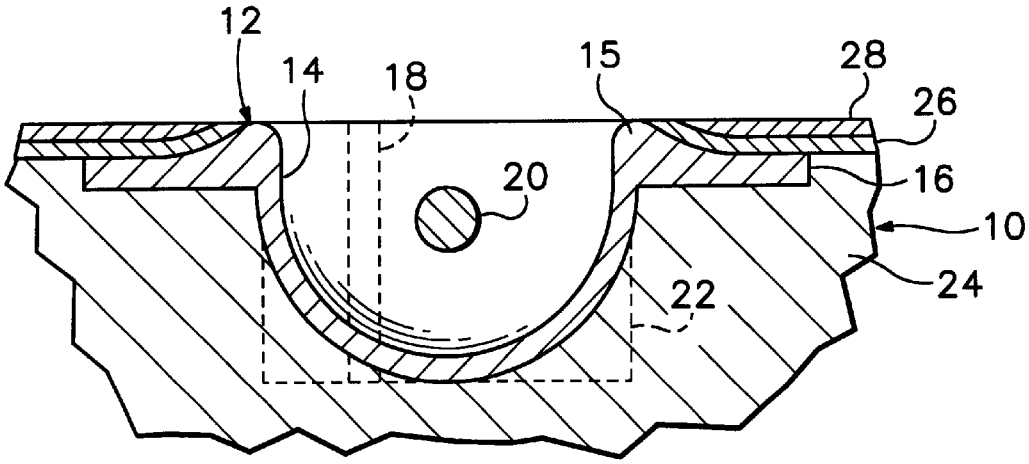
FIG. 4 is a partial cross-sectional view of the surfboard of FIG. 1 taken along line 4—4 of FIG. 3.
Figure 5:
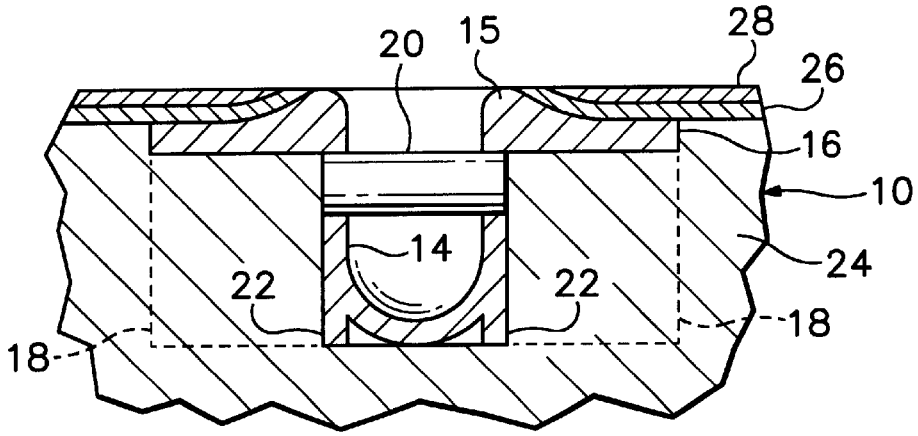
FIG. 5 is a partial cross-sectional view of the surfboard of FIG. 1 taken along line 5—5 of FIG. 3.

Next, the surfboard is sanded. Referring to FIGS. 4 and 5, the sanding operation uncovers the cup portion of 14 of leash plug 12 while leaving the rim 16 covered by layers of resin-impregnated fabric 26 and 28. Moreover, layers 26 and 28 have been sanded flush with the top of ridge 15 so that no side surface of layer 26 or 28 is left to unravel or be exposed to the wearing effects of the seawater. At the completion of the sanding operation, leash plug 12 is positively retained in place by layers of cured, resin-impregnated fiberglass cloth 26 and 28 that have been placed over the rim 16 of leash plug 12.

The advantages of this method of manufacturing and the resultant surfboard should now be readily apparent. There is no need to halt the manufacturing process to wait for a globule of resin to dry after leash plug 12 has been inserted. This is because there is no reliance solely on such a globule of resin to retain the leash plug. Rather, the leash plug is far more firmly and positively retained by the resin-impregnated cloth 26 and 28, thereby forming an integral and tough part of the surfboard 10. This construction is extremely unlikely to permit plug 12 to come loose, even under the strongest tension from the leash. Therefore, this method of manufacturing is much more efficient than current methods and the resultant surfboard contains a more securely anchored leash plug.

In a further preferred embodiment, extension 16 is broken up into an extension (smaller than portion 16) and other additional extensions. The phrase, "an extension," may be used to describe one of the extensions of this embodiment and should not be taken to negative the possible existence of additional extensions. The same principal is true for all of the other elements described in this disclosure.

In one preferred embodiment, the rim 16 is 4.1 cm (1.61 in) long and 3 cm (1.19 in) wide. The interior dimensions of the cup portion 14 are 1.83 cm (0.72 in) long and 0.757 cm (0.298 in) wide. Moreover, the leash plug 12 is 1.5 cm (0.593 in) high, of which 1.12 cm (0.443 in) represents the extent of beneath the rim 16 of wall 18 and cup portion 14 including lip. The greater portion of leash plug 12 is molded out of a mixture of 80% nylon and 20% glass fibers. Cross-bar 20 is made of metal, most typically stainless steel that has been fit through a pair of accommodating holes on either side of cup portion 16. A leash 13 may be attached to cross-bar 20 by means of a clip.

The terms and expressions which have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A surfboard, comprising:

a) a blank made of lightweight, semi-rigid material and having a top major surface;

b) a layer of resin-impregnated cloth adhered to said top major surface; and c) a leash plug including a cup portion and an extension, said cup portion being set into said top major surface of said blank and said extension being interposed between said blank and said layer of resin-impregnated cloth.

2. The surfboard of claim 1 wherein said blank of lightweight, semi-rigid material is made of cellular polystyrene.

3. The surfboard of claim 1 wherein said blank of lightweight, semi-rigid material is made of cellular polyurethane.

4. The surfboard of claim 1 wherein said cloth is made at least in part of fiberglass.

5. The surfboard of claim 1 wherein said extension is a rim encircling said cup portion.

6. The surfboard of claim 1 wherein said leash plug further includes a ridge encircling said cup portion.

7. A method of manufacturing a surfboard, comprising:

a) providing a blank of lightweight semi-rigid material having a top major surface;

b) forming an indentation in said blank at said top major surface;

c) providing a leash plug having a cup portion and an extension extending outwardly from said cup portion;

d) placing said cup portion in said indentation so that said extension extends outwardly from said cup over a portion of said top major surface;

e) placing a cloth over said top major surface, so that said extension is interposed between said top major surface and said cloth;

f) impregnating said cloth with resin;

g) curing said resin.

8. The method of claim 7 wherein said blank of lightweight, semi-rigid material is made of cellular polystyrene.

9. The method of claim 7 wherein said blank of lightweight, semi-rigid material is made of polyurethane.

10. The method of claim 7 wherein said cloth is made at least in part of fiberglass.

11. The method of claim 7 wherein said extension is a rim encircling said cup portion.

12. The method of claim 7 wherein said leash plug further includes a ridge encircling said cup portion.

13. A leash plug having a top and a bottom and comprising:

a) a cup portion having a top at said top of said leash plug, traversed by a cross-bar;

b) a ridge encircling and defining said top of said cup portion;

c) a rim extending outwardly from said ridge; and d) a retention wall extending downwardly from said rim, substantially at a right angle to said rim.

14. The leash plug of claim 13 made, at least in part, of nylon mixed with glass fibers.

* * * * *